US006502413B2

(12) United States Patent
Repice et al.

(10) Patent No.: US 6,502,413 B2
(45) Date of Patent: Jan. 7, 2003

(54) COMBINED EXPANSION VALVE AND FIXED RESTRICTION SYSTEM FOR REFRIGERATION CYCLE

(75) Inventors: Chris Repice, Syracuse, NY (US); Brad Reisfeld, Manlius, NY (US); Robert Chiang, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/824,085

(22) Filed: Apr. 2, 2001

(65) Prior Publication Data

US 2002/0139138 A1 Oct. 3, 2002

(51) Int. Cl.[7] ..... F25B 41/04
(52) U.S. Cl. ..... 62/225; 62/511
(58) Field of Search ..... 62/225, 205, 204, 62/222, 200, 511, 525, 527

(56) References Cited

U.S. PATENT DOCUMENTS 3,677,028 A * 7/1972 Raymond ..... 62/200
4,510,767 A * 4/1985 Komatsu et al. ..... 62/200
4,620,423 A 11/1986 Hopkinson
4,779,425 A * 10/1988 Yoshida et al. ..... 62/200
5,309,728 A * 5/1994 Chae ..... 62/158
5,323,617 A * 6/1994 Ichikawa ..... 62/129
5,388,419 A * 2/1995 Kaye ..... 62/200
5,479,784 A 1/1996 Dobmeier et al.
6,381,974 B1 * 5/2002 Hwang et al. ..... 62/199

* cited by examiner

*Primary Examiner*—William C. Doerrler
*Assistant Examiner*—Mohammad M Ali
(74) *Attorney, Agent, or Firm*—Carlson, Gaskey & Olds

(57) ABSTRACT

A refrigerant cycle has a main expansion valve communicating with an inlet header which in turn communicates with a plurality of flow passages moving towards an evaporator coil. Each of the plurality of passages is provided with an individual restriction which provides additional expansion. The individual restrictions can each be separately controlled or designed such that the flow through each of the passages can be tailored to optimum efficiency and operation within the evaporator coil. However, the use of the main expansion valve in series with these restrictions ensures that each of the restrictions can be relatively simple items. Further, the use of the separate restrictions provides a system which has a simplified inlet header system.

5 Claims, 1 Drawing Sheet

COMBINED EXPANSION VALVE AND FIXED RESTRICTION SYSTEM FOR REFRIGERATION CYCLE

BACKGROUND OF THE INVENTION

This invention relates to the use of a combined expansion valve with a downstream restrictions on separate flow lines leading into a single evaporator. The combination provides better control over the refrigerant flow.

Refrigerant cycles as commonly utilized incorporate an evaporator coil which receives a refrigerant through a plurality of tubes. Typically, the flow of refrigerant will vary across the evaporator coil, and thus the evaporator efficiency is not usually at optimum levels. It would be desirable to provide a system wherein the flow of refrigerant across various positions within the evaporator could be better controlled.

Systems have been suggested wherein there are a plurality of separate refrigerant flow lines each having an expansion valve leading into the evaporator. By varying the several expansion valves, control over the refrigerant in the various positions in the evaporator coil can be achieved. However, this is very complex and expensive. The restrictions can be as simple as a narrowing in the flow line. Further, it is expected and preferred that across the evaporator, restrictions will vary in diameter, and other design characteristics.

Other known systems have utilized a distributor receiving fluid flow from the main expansion valve. The refrigerant leaving the main expansion valve has typically changed into being two-phase, with a mixture of approximately 75% liquid and 25% vapor refrigerant. Of course, the proportions may vary. For the evaporator coil to operate efficiently, each circuit path should receive about the same mixture of liquid and vapor. The distributor's purpose is to insure the flow leading to each of the separate inlets in the coil is roughly the same amount of liquid and vapor. However, such an arrangement requires lengthy tubing, and resulting high cost and labor intensive assembly.

SUMMARY OF THE INVENTION

In the disclosed embodiment of this invention, a main expansion valve is positioned in series with an inlet header having a series of restrictions leading into an evaporator coil. The restrictions each communicate with one flow passage through the evaporator coil. Refrigerant leaving the condenser passes into the main expansion valve, and is expanded. The entire expansion work is not performed at the main expansion valve. Instead, from the expansion valve the refrigerant flows into an inlet header. The inlet header communicates with several flow passages each having individual restrictions. The flow passages communicate with separate flow lines through the evaporator coil. The separate restrictions allow individual control over each of the flow lines such that the refrigerant flow through various locations in the evaporator coil can be optimized. However, since the main expansion valve does the bulk of the expansion work, the restrictions can be relatively simple and inexpensive.

The use of the orifices allows specific control over each of the flow lines. Thus, the present invention provides a system which is able to better control the efficiency of refrigerant cycles with a relatively low cost solution.

Further, the use of the separate orifices on each line eliminates any need for a distributor. The orifices can be designed to insure a roughly equal mixture of liquid and vapor.

These and other features of the present invention can be best understood from the following specification and drawings, the following of which is a brief description.

DETAILED DESCRIPTION OF A PREFERRED EMBODIMENT

Figure 1:
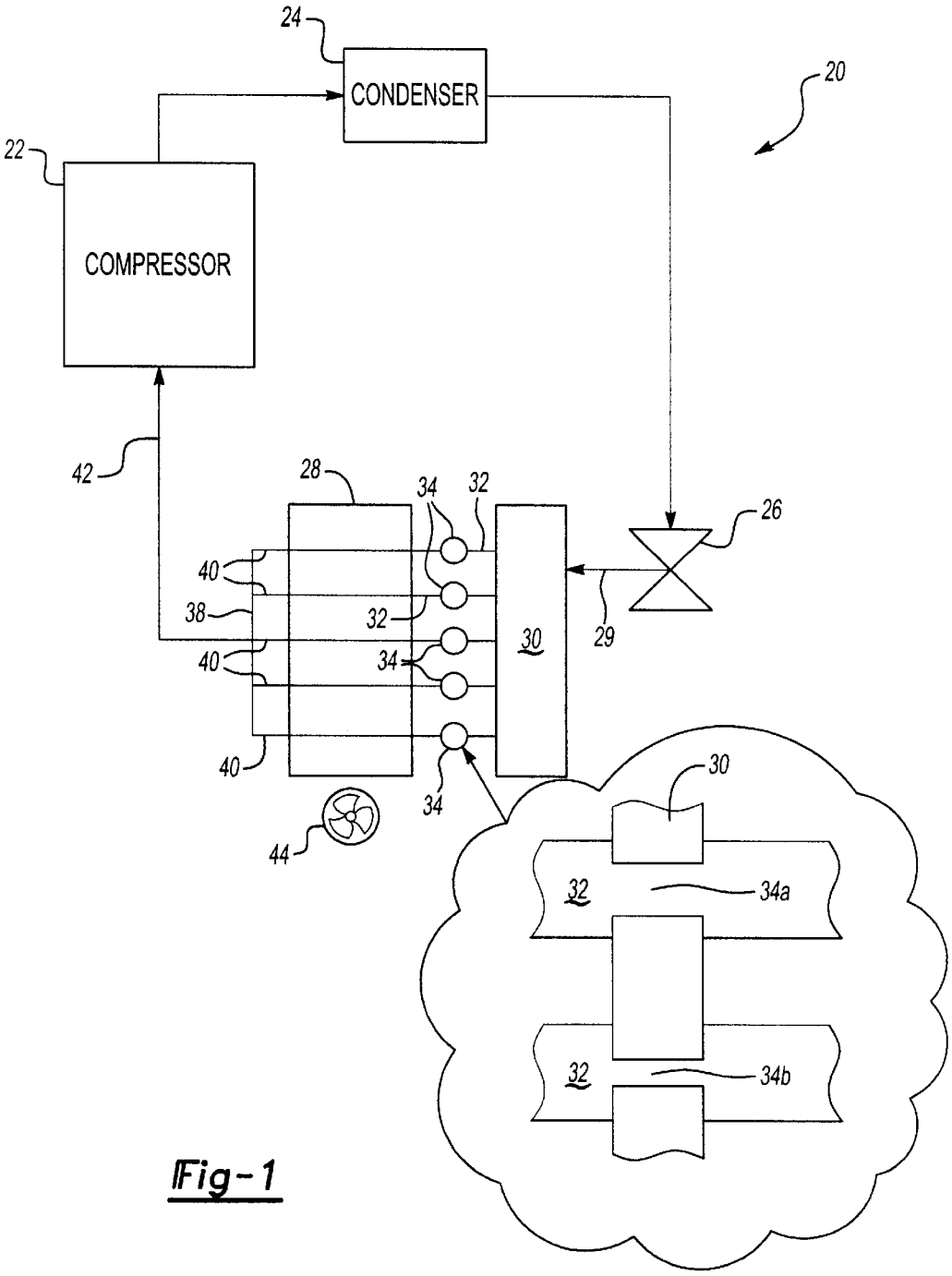
FIG. 1 is a schematic view of a system incorporating the present invention.

A refrigerant cycle 20 is illustrated in FIG. 1 having a compressor 22 feeding a compressed refrigerant to a condenser 24. As known from the condenser 24 the refrigerant flows to an expansion valve 26. Expansion valve 26 may be as known, and is controllable to achieve varying levels of expansion. The FIG. 1 refrigerant cycle 20 is an over simplification. Real world systems incorporating the present invention may include other components such as economizer cycles, etc. From the expansion valve 26, the refrigerant passes toward an evaporator coil 28. The main refrigerant flow line 29 leaving the expansion valve 26 passes into an inlet header 30. Inlet header 30 communicates with a plurality of separate refrigerant flow lines 32 each passing through a separate restriction or orifice 34. Each restriction 34 provides a restriction on the flow that results in some expansion of the flow through the line 32. The restrictions 34 are preferably relatively low cost components. In particular, the restrictions can be as simple as a narrowing in the flow line, or a small hole through a plate placed intermediate in the flow line. Most preferably, and to achieve the goals of this invention, it is likely that across the several flow passages leading through the evaporator coil, there would be different sizes in the restrictions. Thus, the restriction 34A is shown in an enlarged portion of the figure to be larger than the restriction 34B. This is simply to illustrate the distinct controls which can be achieved with low cost components in the present invention. As shown schematically in this figure, each line 32 remains separate through the evaporator coil 28 and extends to another passage 40 which communicates in an outlet header 38. Outlet header 38 then communicates with a main flow line 42 returning to the compressor 22.

As is known, a fan 44 passes air over the evaporator coil 28.

In the prior art, the efficiency of cooling across the evaporator coil 38 varies through the several passages. The refrigerant flow is not uniform across the evaporator coil, nor is the cooling efficiency.

The present invention allows separate control of each of the refrigerant flow lines 32 by varying the restrictions 34. In this way, optimum efficiency can be achieved. However, since the main expansion valve 26 does the bulk of the expansion work, each restriction 34 may be a relatively simple item.

How a worker in this art would want to modify the passages 32 and restrictions 34 is within the skill of a worker in this art. That is, how the restrictions 34 are to be designed would be within the skill of a worker in the art. It is the provision of this system which allows for the fine control which is inventive here.

As mentioned above, the inventive arrangement also eliminates any need for a distributor and the resulting tube lines, etc. The invention allows a simple inlet header with a relatively low cost arrangement. Since the expansion is now done in two stages, the main expansion valve will only complete a portion of the total required expansion. As an example, the main expansion valve could perform 10–50% of the required expansion, but the range could vary beyond this. Thus, the refrigerant leaving the main expansion valve and entering the inlet header is low, and virtually all liquid. Thus, there is little risk for uneven splitting between the several circuits.

Also, the location of where the inlet tube connects to the header can be varied between the top, middle and bottom to achieve desired design characteristics.

A worker in this art would recognize that while a preferred embodiment has been disclosed, modifications would come within the scope of this invention. For that reason the following claims should be studied to determine the true scope and content of this invention.

What is claimed is:

1. A refrigerant cycle comprising:

a compressor communicating with a condenser, said condenser passing a refrigerant to a main expansion valve, said refrigerant passing through said main expansion valve; and a plurality of flow passages in communication with said main expansion valve, and passing to an evaporator, each of said plurality of flow passages including a restriction, refrigerant passing through said main expansion valve being delivered to said plurality of flow passages, then said evaporator coil and then back to said compressor.

2. A refrigerant cycle as set forth in claim 1, wherein said restrictions on said plurality of said flows line being set at different sizes.

3. A refrigerant cycle as set forth in claim 1, wherein said main expansion valve communicates with an inlet header, said inlet header communicating with said plurality of flow lines.

4. A refrigerant cycle as set forth in claim 1, wherein said flow passages including the restriction result in a simplified inlet header.

5. A method of providing a refrigerant cycle comprising the steps of:

1) providing a compressor, a condenser, a main expansion valve and an evaporator coil, and providing an inlet header communicating with a downstream end of said main expansion valve, said inlet header communicating with a plurality of flow lines each passing to said evaporator coil, and each of said plurality of lines being provided with a restriction;

2) passing a refrigerant from said condenser through said main expansion valve, and into said inlet header, and then through said plurality of passages and said restrictions on said plurality of lines;

3) passing said refrigerant through said evaporator coil and back to said compressor; and 4) wherein said restrictions on said plurality of lines are varied to provide optimum system operation.

* * * * *